US008523147B2

(12) United States Patent
Zheng

(10) Patent No.: US 8,523,147 B2
(45) Date of Patent: Sep. 3, 2013

(54) ELECTRIC CAPSTAN

(75) Inventor: Mingkui Zheng, Ningbo (CN)

(73) Assignee: Ningbo Chima Winch Co., Ltd., Ningbo (CN)

( * ) Notice: Subject to any disclaimer, the term of this patent is extended or adjusted under 35 U.S.C. 154(b) by 140 days.

(21) Appl. No.: 13/183,402

(22) Filed: Jul. 14, 2011

(65) Prior Publication Data

US 2012/0114508 A1 May 10, 2012

(30) Foreign Application Priority Data

Nov. 9, 2010 (CN) ..... 2010 2 0612014 U
Jan. 20, 2011 (CN) ..... 2011 2 0018102 U

(51) Int. Cl.
*B66D 1/14* (2006.01)

(52) U.S. Cl.
USPC ..... 254/345; 254/342; 254/346

(58) Field of Classification Search
USPC ..... 254/323, 342–346
See application file for complete search history.

(56) References Cited

U.S. PATENT DOCUMENTS 3,162,424 A * 12/1964 Hatlapa ..... 254/274
3,440,896 A * 4/1969 Jones ..... 74/413
3,847,378 A * 11/1974 Roemer, Jr. ..... 254/265
4,004,780 A * 1/1977 Kuzarov ..... 254/345
4,312,497 A * 1/1982 Whaley ..... 254/344
4,396,102 A * 8/1983 Beach ..... 192/99 S
4,426,064 A * 1/1984 Healy ..... 254/342
4,545,567 A * 10/1985 Telford et al. ..... 254/344
4,588,167 A * 5/1986 Finzel ..... 254/346
5,584,207 A * 12/1996 Paul et al. ..... 74/89.22
5,860,635 A * 1/1999 Morfitt et al. ..... 254/377
5,863,028 A * 1/1999 Dunsmore ..... 254/343
5,927,691 A * 7/1999 Ottemann ..... 254/344
5,947,166 A * 9/1999 Doyle et al. ..... 140/119
5,967,934 A * 10/1999 Ishida et al. ..... 475/269
6,170,774 B1 * 1/2001 Akashi et al. ..... 242/356.6
6,659,430 B2 * 12/2003 O'Fallon ..... 254/344
6,663,086 B2 * 12/2003 Huang ..... 254/344
7,891,641 B1 * 2/2011 Miller ..... 254/346
7,984,894 B1 * 7/2011 Chauza ..... 254/344
2003/0111654 A1 * 6/2003 Huang ..... 254/344

* cited by examiner

*Primary Examiner* — Emmanuel M Marcelo
(74) *Attorney, Agent, or Firm* — Morrison & Foerster LLP

(57) ABSTRACT

An electric capstan that is able to easily and accessibly connect external functional models and accomplish multiple functions with good reliability. This electric capstan includes a motor, a reduction gear and a winching roller, and further includes an engagement-disengagement gear and functional module, wherein the input end of the engagement-disengagement gear is connected to the output shaft of the motor and the output end of the engagement-disengagement gear is connected to the input end of the functional module.

9 Claims, 2 Drawing Sheets

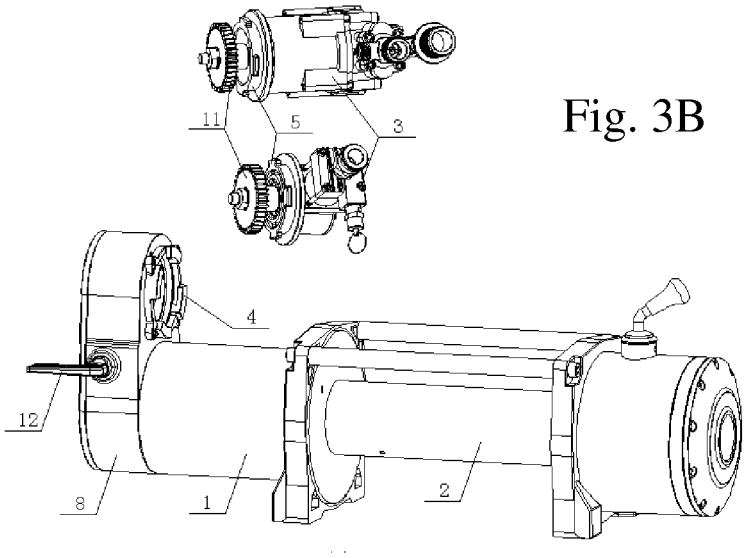
Fig. 3B
Fig. 3A
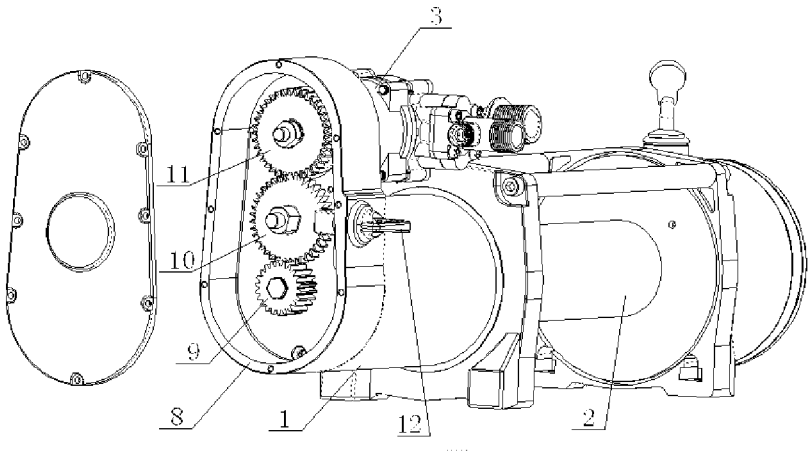
Fig. 4

ELECTRIC CAPSTAN

CROSS-REFERENCE(S) TO RELATED APPLICATION(S)

This application claims priority to Chinese Patent Application No. 201020612014.6, filed Nov. 9, 2010, and to Chinese Patent Application No. 201120018102.8, filed Jan. 20, 2011, each of which is hereby incorporated by reference in the present disclosure in its entirety.

BACKGROUND

1. Field

The present disclosure relates generally to capstans, and more specifically to electric capstans.

2. Description of Related Art

At present, electric capstan in the related art includes a motor, a reduction gear and a winching roller, wherein the output shaft of the motor is connected to the reduction gear, and then the reduction gear is connected to the winching roller. Electric capstans are mainly used in off-road vehicle, agricultural vehicle, barge and other special vehicles, and are used as a self-protection device and a traction device for a vehicle or a ship. In the case of driving vehicles or ships for purpose of traction operation and rescue operation (including self-rescue operation), electric capstans act an important part.

However, in the practical purposes, in addition to the traction function, sometimes there is a need for being supplied with water. For example, especially, the off-road vehicle, the agricultural vehicle and the barge can be easily stained with feculency such as mud and thus pollute the vehicle body or ship body thereof, when they are operated in the wild or outdoors. Here, water is needed to flush the stained vehicle or ship. In order to solve above problem, a typical solution, at present, is to equip the vehicle or ship with a separate water pump. The equipment with a separated water pump may not only occupy the space inside the vehicles or ships, but also increase the weight and cost.

Similarly, in order to accomplish further functions, the vehicles or ships are required to be equipped with devices with respective functions. Therefore, much more space inside the vehicles or ships may be occupied to mount the devices with respective functions, thus causing a great increment in cost.

BRIEF SUMMARY

One object of the present disclosure is to provide an electric capstan which is able to easily and accessibly connect external functional models to further accomplish multiple functions and which has a good reliability.

The object of the present disclosure may be accomplished by following configuration. An electric capstan of the disclosure includes a motor, a reduction gear and a winching roller, and further includes an engagement-disengagement gear and functional module, wherein the input end of the engagement-disengagement gear is connected to the output shaft of the motor and the output end of the engagement-disengagement gear is connected to the input end of the functional module.

Compared with the related art, the present disclosure, with such above configuration, has following advantages. The electric capstan according to the present disclosure includes an engagement-disengagement gear and functional module, wherein the input end of the engagement-disengagement gear is connected to the output shaft of the motor and the output end of the engagement-disengagement gear is connected to the input end of the functional module. As a result, the functional module is integrated with the electric capstan, and thus the electric capstan can accomplish multiple functions through the variable attached external functional modules and have a good reliability.

As a modification, the engagement-disengagement gear and the functional module both have accessible interfaces for facilitating the removable connection therebetween, wherein a first connecting member is arranged at the engagement-disengagement gear, and a second connecting member is arranged at the functional module. As a result, this can facilitate the accessible assembly between the engagement-disengagement gear and the functional module and allow the present disclosure to be conveniently used.

As a further modification, the engagement-disengagement gear includes a clutch and a lever that is able to engage or disengage the clutch, wherein the clutch has a groove, the lever at the end thereof has an eccentric and axial protrusion which can be embedded in the groove of the clutch, and the lever is rotatably attached to the housing of the clutch. Although the engagement-disengagement gear can be only mounted in the axial direction of motor, this engagement-disengagement gear has a simple and reliable structure, high transmission efficiency and easy manipulation, which is advantageous to implement the electric capstan according to the present disclosure and improve the performance thereof.

As a further modification, the output end of the engagement-disengagement gear is located on the sideface of the motor. Since the output end of the engagement-disengagement gear is connected to the input end of the functional module, when the output end of the engagement-disengagement gear is located on the sideface of the motor, the functional module is located on the sideface of the motor. As a result, the dimension of the electric capstan in the axial direction thereof can greatly reduce, that is the dimension of the electric capstan in the lengthwise direction thereof can greatly reduce, and therefore, the electric capstan according to the present disclosure has an advantage that it can be mounted on an object which provides a narrow mounting place.

As a further modification, the functional module is located above the sideface of the motor. As a result, this can make the whole structure of the electric capstan more compact and mounting of the functional module more convenient.

As a further modification, the engagement-disengagement gear includes a bracket, a first gear, a second gear, a third gear and an engagement-disengagement handle that can be operated so as to move the second gear in the axial direction of the revolution shaft thereof and further engaged with or disengaged from the first gear, wherein the engagement-disengagement handle is mounted on the bracket, the movable end of the engagement-disengagement handle is located on the side of the second gear, the bracket is connected to the housing of the motor, the first connecting member is mounted on the bracket; the connection of the input end of the engagement-disengagement gear and the output shaft of motor means the connection of the first gear and the output shaft of motor; the second gear is mounted on the bracket; the connection of the output end of the engagement-disengagement gear and the input end of the functional module means the connection of the third gear and the input end of the functional module; the first gear, the second gear and the third gear are engaged successively. As a result, since the three gears constitute a gear transmission mechanism, the engagement-disengagement gear has a simple and reliable structure and a light weight, and therefore, it is advantageous for the electric capstan to be mounted on transportation such as a vehicle.

As a further modification, the first and second connecting members have chuck structures that can be matched each other. The chucks that can be matched each other have a simple and reliable structure. Such a structure not only allows the electric capstan to easily and accessibly connect external functional models, but also improves reliability of the connection between engagement-disengagement gear and functional module. Therefore, this makes the electric capstan according to the present disclosure more compact, simple and convenient for bringing into produce.

DESCRIPTION OF THE FIGURES

FIGS. 1A and 1B depict an exemplary structural view of the electric capstan according to the first embodiment of the present disclosure, wherein FIG. 1A depicts a motor, a winching roller, a first connecting member, a clutch, and a lever, and FIG. 1B depicts two exemplary functional modules (water pump on top and air pump on bottom) and a second connecting member;

FIGS. 3A and 3B depict an exemplary structural view of the electric capstan according to the second embodiment of the present disclosure, wherein FIG. 3A depicts a motor, a winching roller, a first connecting member, a bracket, and an engagement-disengagement handle, and FIG. 3B depicts two exemplary functional modules (water pump on top and air pump on bottom), a second connecting member, and a third gear; and FIG. 4 is another exemplary structural view of the electric capstan according to the second embodiment of the present disclosure.

Figure 1A:
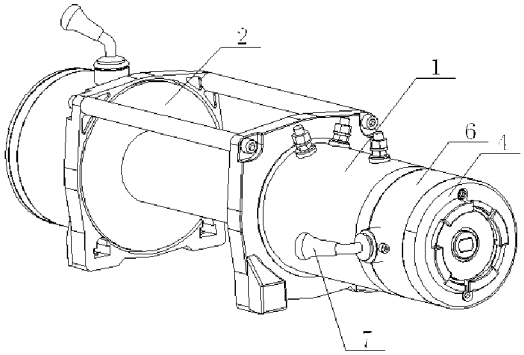

In the figures, reference numeral 1 indicates a motor, reference numeral 2 indicates a winching roller, reference numeral 3 indicates functional module, reference numeral 4 indicates a first connecting member, reference numeral 5 indicates a second connecting member, reference numeral 6 indicates a clutch, reference numeral 7 indicates a lever, reference numeral 8 indicates a bracket, reference numeral 9 indicates a first gear, reference numeral 10 indicates a second gear, reference numeral 11 indicates a third gear and reference numeral 12 indicates an engagement-disengagement handle.

DETAILED DESCRIPTION

The following description sets forth exemplary methods, parameters and the like. It should be recognized, however, that such description is not intended as a limitation on the scope of the present disclosure but is instead provided as a description of exemplary embodiments.

The details of the present disclosure are set forth in the accompanying drawings and the embodiments below.

First Embodiment

Figure 1B:
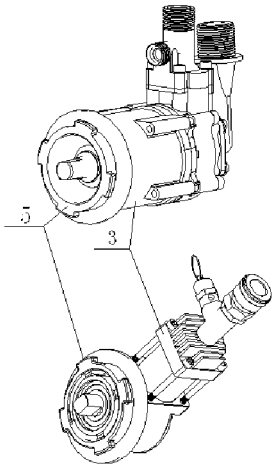
Figure 2:
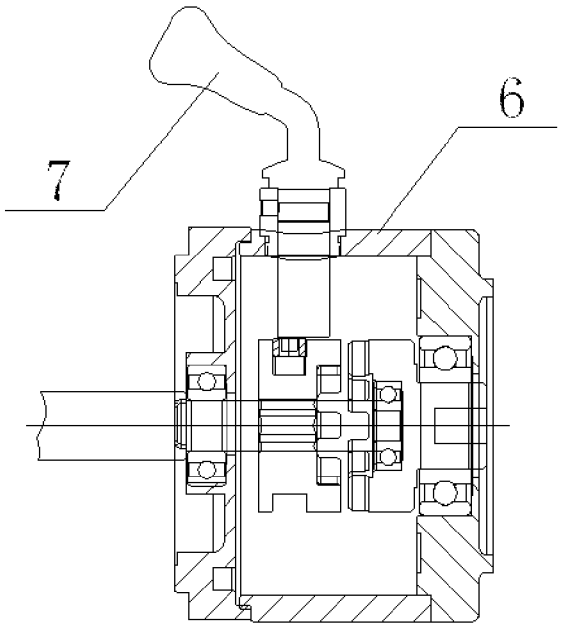
FIG. 2 is an exemplary cross-sectional view, in enlarged manner, showing the engagement-disengagement gear of the electric capstan according the first embodiment of to the present disclosure.

In the first embodiment of the present disclosure, as shown in FIGS. 1 and 2, an electric capstan includes a motor 1, a reduction gear and a winching roller 2, and further includes an engagement-disengagement gear and functional module 3. The input end of the engagement-disengagement gear is connected to the output shaft of the motor 1 and the output end of the engagement-disengagement gear is connected to the input end of the functional module 3. Also, the output shaft of the motor 1 is connected to the reduction gear, and the reduction gear is connected to the winching roller 2.

The engagement-disengagement gear and the functional module 3 both have accessible interfaces for facilitating the removable connection therebetween. A first connecting member 4 is arranged at the engagement-disengagement gear, and a second connecting member 5 is arranged at the functional module 3.

The engagement-disengagement gear includes a clutch 6 and a lever 7 that is able to engage or disengage the clutch 6. The clutch 6 has a groove, and the lever 7 at the end thereof has an eccentric and axial protrusion which can be embedded in the groove of the clutch. The lever 7 is rotatably attached to the housing of the clutch 6.

Such above configuration is shown in FIGS. 1A and 1B or 2. FIG. 1B schematically depicts two functional modules 3 (the upper one is a water pump, and the lower one is an air pump), and the two functional modules 3 are in a condition that they are removed from the electric capstan.

Second Embodiment

In the second embodiment of the present disclosure, as shown in FIGS. 3 and 4, an electric capstan includes a motor 1, a reduction gear and a winching roller 2, and further includes an engagement-disengagement gear and functional module 3. The input end of the engagement-disengagement gear is connected to the output shaft of the motor 1, and the output end of the engagement-disengagement gear is connected to the input end of the functional module 3. Also, the output shaft of the motor 1 is connected to the reduction gear, and the reduction gear is connected to the winching roller 2.

The engagement-disengagement gear and the functional module 3 have accessible interfaces for facilitating the removable connection therebetween. A first connecting member 4 is arranged at the engagement-disengagement gear, and a second connecting member 5 is arranged at the functional module 3.

The output end of the engagement-disengagement gear is located on the sideface of the motor 1, the functional module 3 is located above the sideface of the motor 1, and the axis of the input shaft of the functional module 3 is in parallel with the axis of the output shaft of the motor 1.

The engagement-disengagement gear includes a bracket 8, a first gear 9, a second gear 10, a third gear 11 and an engagement-disengagement handle 12 that can be operated so as to move the second gear 10 in the axial direction of the revolution shaft thereof and further engaged with or disengaged from the first gear 9. The engagement-disengagement handle 12 is mounted on the bracket 8. The movable end of the engagement-disengagement handle 12 is located on the side of the second gear 10. The bracket 8 is connected to the housing of the motor 1. The first connecting member 4 is mounted on the bracket 8. The connection of the input end of the engagement-disengagement gear and the output shaft of motor 1 means the connection of the first gear 9 and the output shaft of motor 1. The second gear 10 is mounted on the bracket 8. The connection of the output end of the engagement-disengagement gear and the input end of the functional module 3 means the connection of the third gear 11 and the input end of the functional module 3. The first gear 9, the second gear 10 and the third gear 11 are engaged successively.

Such above configuration is shown in FIGS. 3A and 3B or 4. FIG. 3B schematically depicts two functional modules 3 (the upper one is a water pump, and the lower one is an air pump), and the two functional modules 3 are in a condition that they are removed from the electric capstan.

In this embodiment, the third gear 11 may be attached on the functional module 3 and removed along with the functional module 3 from the electric capstan. Therefore, each of the functional modules 3 is provided with a third gear 11.

The preferable first and second embodiments according to the present disclosure have been described above. In the embodiments, the first and second connecting members 4 and 5 both have chuck structures that can be matched each other. In addition, the functional module 3 may be a water pump, an oil pump, an air pump, a vacuum cleaner, a reduction gear built-in air pump or an acceleration gear built-in vacuum cleaner.

What is claimed is:

1. An electric capstan comprising:

a motor, wherein the motor has an output shaft, a reduction gear, a winching roller, an engagement-disengagement gear, wherein the engagement-disengagement gear has an input end and an output end, and a functional module, wherein the functional module has an input end and an output end, wherein the input end of the engagement-disengagement gear is connected to the output shaft of the motor and the output end of the engagement-disengagement gear is connected to the input end of the functional module, and wherein the engagement-disengagement gear includes a clutch and a lever that is able to engage or disengage the clutch, wherein the clutch has a housing and a groove, the lever at the end thereof has an eccentric and axial protrusion which can be embedded in the groove of the clutch, and the lever is rotatably attached to the housing of the clutch.

2. The electric capstan according to claim 1, wherein:

the engagement-disengagement gear and the functional module both have accessible interfaces for facilitating the connection therebetween, wherein a first connecting member is arranged at the engagement-disengagement gear, and a second connecting member is arranged at the functional module.

3. The electric capstan according to claim 2, wherein:

the motor has a housing, the engagement-disengagement gear includes a bracket, a first gear, a second gear, a third gear and an engagement-disengagement handle that can be operated so as to move the second gear in the axial direction of a revolution shaft thereof and further engaged with or disengaged from the first gear, the engagement-disengagement handle is mounted on the bracket, the movable end of the engagement-disengagement handle is located on the side of the second gear, the bracket is connected to the housing of the motor, a first connecting member is mounted on the bracket;

the connection of the input end of the engagement-disengagement gear and the output shaft of motor is the connection of the first gear and the output shaft of the motor;

the second gear is mounted on the bracket;

the connection of the output end of the engagement-disengagement gear and the input end of the functional module is the connection of the third gear and the functional module;

the first gear, the second gear and the third gear are engaged successively.

4. The electric capstan according to claim 2, wherein:

the first and second connecting members both have chuck structures that can be matched to each other.

5. The electric capstan according to claim 1, wherein:

the motor has a sideface, and the output end of the engagement-disengagement gear is located on the sideface of the motor.

6. The electric capstan according to claim 5, wherein:

the motor has a housing, the engagement-disengagement gear includes a bracket, a first gear, a second gear, a third gear and an engagement-disengagement handle that can be operated so as to move the second gear in the axial direction of a revolution shaft and further engaged with or disengaged from the first gear, the engagement-disengagement handle is mounted on the bracket, the movable end of the engagement-disengagement handle is located on the side of the second gear, the bracket is connected to the housing of the motor, a first connecting member is mounted on the bracket;

the connection of the input end of the engagement-disengagement gear and the output shaft of motor is the connection of the first gear and the output shaft of the motor;

the second gear is mounted on the bracket;

the connection of the output end of the engagement-disengagement gear and the input end of the functional module is the connection of the third gear and the functional module;

the first gear, the second gear and the third gear are engaged successively.

7. The electric capstan according to claim 1, wherein:

the motor has a sideface, and the functional module is located above the sideface of the motor.

8. The electric capstan according to claim 1, wherein:

the motor has a housing, the engagement-disengagement gear includes a bracket, a first gear, a second gear, a third gear and an engagement-disengagement handle that can be operated so as to move the second gear in the axial direction of a revolution shaft thereof and further engaged with or disengaged from the first gear, the engagement-disengagement handle is mounted on the bracket, the movable end of the engagement-disengagement handle is located on the side of the second gear, the bracket is connected to the housing of the motor, a first connecting member is mounted on the bracket;

the connection of the input end of the engagement-disengagement gear and the output shaft of motor is the connection of the first gear and the output shaft of the motor;

the second gear is mounted on the bracket;

the connection of the output end of the engagement-disengagement gear and the input end of the functional module is the connection of the third gear and the functional module;

the first gear, the second gear and the third gear are engaged successively.

9. The electric capstan according to claim 1, wherein:

the functional module is selected from the group consisting of a water pump, an oil pump, an air pump, a vacuum cleaner, a reduction gear built-in air pump, and an acceleration gear built-in vacuum cleaner.

* * * * *